US008397611B2

(12) United States Patent
Mejia

(10) Patent No.: US 8,397,611 B2
(45) Date of Patent: Mar. 19, 2013

(54) MACHINE AND METHOD WITH MAGNETS FOR PLAITING THREADS

(75) Inventor: David Vallejo Mejia, Medellin (CO)

(73) Assignees: DVM Tecnologia S.A.S, Envigado (CO); John J. Martinez, Croton On Hudson, NY (US)

( * ) Notice: Subject to any disclaimer, the term of this patent is extended or adjusted under 35 U.S.C. 154(b) by 86 days.

(21) Appl. No.: 12/837,508

(22) Filed: Jul. 16, 2010

(65) Prior Publication Data

US 2012/0012620 A1 Jan. 19, 2012

(51) Int. Cl.
*D04C 3/14* (2006.01)

(52) U.S. Cl. ..... 87/55

(58) Field of Classification Search ..... 87/15, 18, 87/19, 20, 50, 55
See application file for complete search history.

(56) References Cited

U.S. PATENT DOCUMENTS

| | | | | | |
|---|---|---|---|---|---|
| 1,491,839 | A * | 4/1924 | Adams | 87/15 |
| 2,506,315 | A * | 5/1950 | Petersen | 87/44 |
| 4,311,080 | A * | 1/1982 | Leonard | 87/44 |
| 4,312,261 | A * | 1/1982 | Florentine | 87/33 |
| 4,800,796 | A * | 1/1989 | Vendramini | 87/5 |
| 4,936,186 | A * | 6/1990 | Sekido et al. | 87/8 |
| 5,176,062 | A * | 1/1993 | Maillefer | 87/51 |
| 5,301,596 | A * | 4/1994 | Huey, Jr. | 87/8 |
| 5,904,087 | A * | 5/1999 | Freitas et al. | 87/54 |
| 6,128,998 | A * | 10/2000 | Freitas et al. | 87/8 |
| 6,647,852 | B1 * | 11/2003 | Freitas et al. | 87/1 |

* cited by examiner

*Primary Examiner* — Shaun R Hurley
(74) *Attorney, Agent, or Firm* — Martinez Patents P.C.; John J. Martinez

(57) ABSTRACT

The present invention provides a machine and method wherein there is no physical contact between one or more thread or filaments reels and the element that generates the movement of said reel or reels in such a way that the thread or filament provided by said reel or reels can form a braid. The element that generates the movement of the reel or reels have a magnetic constituent, wherein the magnetic constituent remotely pulls into moving the device or devices holding the reel or reels.

13 Claims, 8 Drawing Sheets

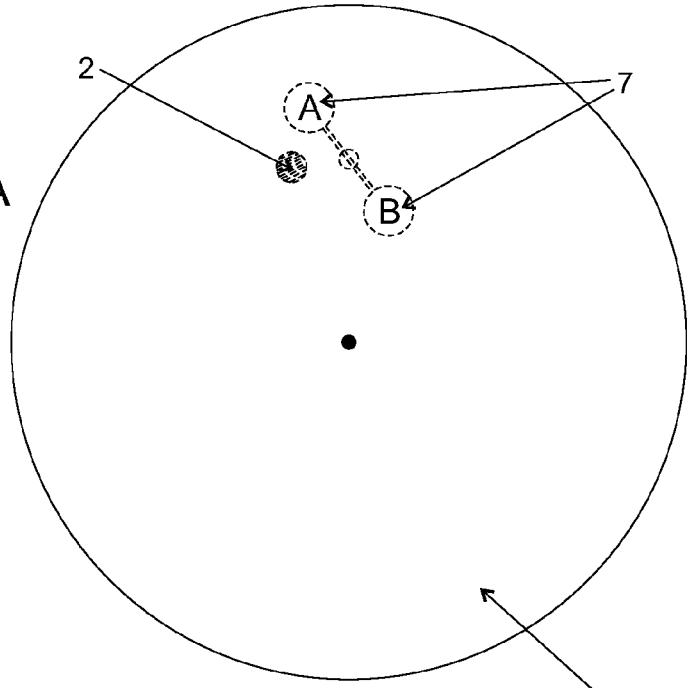
FIG. 8A
FIG. 8
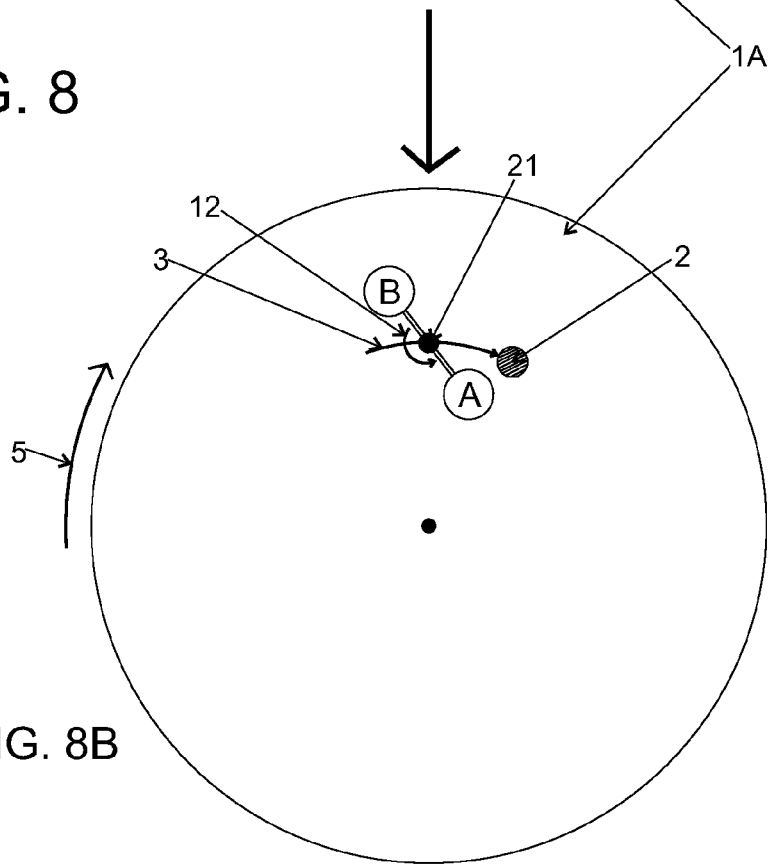
FIG. 8B

MACHINE AND METHOD WITH MAGNETS FOR PLAITING THREADS

BACKGROUND OF THE INVENTION

1. Field of the Invention

The present invention is related to a machine and a method of plaiting threads resulting in braids, wherein thread can be made of all types of materials, e.g., cotton, metal, synthetic polymers, alloys, carbon, etc. Therefore, the machine and the method of the present invention would be used in a broad variety of industries.

2. Description of Prior Art

Machines to make braids have the limitation of being complex machines because the braids are made from filament, threads, strands, or fibers provided by a reels or cylinders, wherein the each reel or cylinder is physically connected to an element which moves around the reel or cylinder the filament from each reel or cylinder is released, wherein the multiples released filaments form braid. This need of a physical contact element to move the reels or cylinders in such a way that braids are formed make this kind of machines costly not only to make, but also to maintain. An example of this type of braiding machine is described by Leon Bettger, J. et al. in U.S. Pat. No. 6,360,644.

The present invention overcomes the above mentioned limitation, the need of a physical contact element to move the reels or cylinders that provide the threads or filaments which would form a braid.

SUMMARY OF THE INVENTION

The present invention provides a machine and method wherein there is no physical contact between one or more thread or filaments reels and the element that generates the movement of said reel or reels in such a way that the thread or filament provided by said reel or reels can form a braid. The element that generates the movement of the reel or reels have a magnetic constituent, wherein the magnetic constituent remotely pulls into moving the device or devices holding the reel or reels.

Specifically, the present invention provides a machine for plaiting, wherein a first embodiment of the machine comprises:

A. A circular movement platform, wherein the circular movement platform has on top at least one fixed thread reel that moves along a first circumference path with the platform, wherein the platform has a center leg, wherein the platform and the center leg are moved circularly by a first motor that moves the center leg and the platform in a circular movement; B. At least one magnetic stand, wherein the magnetic stand serves as the base for a magnetic stand based thread reel, wherein the magnetic stand lies unattached over the platform, wherein the magnetic stand moves freely over the platform; and, C. At least one arm with at least one control magnet, wherein the control magnet is immediately underneath the platform exactly below the magnetic stand, wherein the control magnet is moved circularly by a second motor, wherein the control magnet emits a magnetic force that moves the magnetic stand in a independent circular movement, and wherein the control magnet and the magnetic stand follow the same synchronous independent circular movement;

Wherein the magnetic stand based thread reel releases a first thread end, wherein the fixed thread reel releases a second thread reel, wherein, as the magnetic stand moves circularly, the first thread end and the second thread end form a braid.

In one aspect of the machine of the present invention, the braid is rolled into a braid reel.

In another aspect of the machine of the present invention, the at least one arm has at least two control magnets, wherein the machine also has at least two magnetic stands, wherein the at least two magnetic stands move following an independent circular movement, wherein the at least two magnetic stands are opposite an symmetrically positioned on the imaginary circular perimeter of the independent circular movement, wherein the at least two control magnets are immediately underneath the platform, wherein the at least two control magnets are exactly below the at least two magnetic stands, wherein the at least two control magnets govern the independent circular movement of the at least two magnetic stands.

In one more aspect of the machine of the present invention, the arm is supported on a wing, wherein the arm is on the wing end, wherein the wing is attached to an axial support, wherein the second motor is at the wing body, wherein the wing and the axial support move following a circular movement around the same axis of the circular movement of the center leg and the platform, wherein the machine also has a third motor that moves circularly the wing and the axial support, wherein the circular movement of the wing displaces the control magnet circularly, wherein the control magnets pulls the magnetic stand making the magnetic stand to move following a displacement movement over the platform, wherein the magnetic stand circular movement is independent of the magnetic stand displacement movement, wherein the magnetic stand displacement movement is along a second circumference path, wherein the first circumference path and the second circumference path are parallel.

In a second embodiment of the machine for plaiting of the present invention, the machine comprises:

A. A fixed platform that has on top at least one fixed thread reel, wherein the fixed thread reel is positioned in a point that coincides with perimeter line of a first circumference path;

B. At least one magnetic stand, wherein the magnetic stand serves as support for a magnetic stand based thread reel, wherein the magnetic stand lies unattached over the platform, wherein the magnetic stand moves freely over the platform;

C. At least one circular movement wing with an axial support, wherein the circular movement wing with the axial support is moved by a center motor, wherein at the end of the circular movement wing there is a independent circular movement arm controlled by a wing motor located at said wing body, wherein at the independent circular movement arm there is at least one control magnet, wherein the control magnet is underneath the platform, wherein the control magnet is exactly below the magnetic stand, wherein, as the arm moves circularly, the control magnet moves circularly; wherein the wing circular movement around the axial support displaces the arm with control magnet around the axial support, wherein the control magnet emits a force that pulls the magnetic stand to move following a displacement movement over the platform, wherein the control magnet force also pulls the magnetic stand into an independent circular movement, wherein both, the control magnet, and the magnetic stand, have the same synchronous circular movement and the same displacement movement, and wherein the magnetic stand displacement movement over the platform follows a second circumference path, wherein the first circumference path and the second circumference path are parallel;

Wherein the magnetic stand based thread reel releases a first thread end, wherein the fixed thread reel releases a second thread reel, wherein, as the magnetic stand moves circularly, the first thread end and the second thread end form a braid.

In an aspect of the second embodiment of the machine of the present invention, the braid is rolled into a braid reel.

In another aspect of the second embodiment of the machine of the present invention, at the independent movement arm there is at least two control magnets, wherein the at least two control magnets are underneath the platform, wherein the machine also has at least two magnetic stands that serve as bases for two thread reels, wherein the at least two magnetic stands lie unattached on top of the platform, wherein at least two magnetic stands move freely on top of the platform, wherein at least two magnetic stands are exactly above the at least two control magnets, wherein the at least two control magnets emit a force that pulls the at least two magnetic stands, wherein both, the control magnets, and the magnetic stands, have the same synchronous circular movement and the same displacement movement.

The present invention also provides a method of plaiting braids in a machine, wherein the machine comprises:

A. A platform

B. At least one magnetic stand lying on top of the platform, wherein on top of the magnetic stand there is a magnetic stand based thread reel, C. At least one fixed thread reel attached on top of the platform;

D. A least one control magnet underneath the platform, wherein the control magnet is exactly below the magnetic stand, wherein the control magnet is on an arm, wherein the arm is moved circularly by a motor, wherein the control magnet emits a magnetic force that pulls the magnetic stand, wherein the magnetic stand also moves circularly and synchronously with the control magnet, wherein the magnetic stand thread reel releases a first thread end, and wherein fixed thread reel releases a second thread reel, wherein, as the magnetic stand moves circularly, the first thread end and the second thread end form a braid.

In an aspect of the method of the present invention, the arm has at least two control magnets, and the machine also has two magnetic stands with magnetic stand based thread reels, wherein the two control magnets are positioned opposite on the arm, wherein the two magnetic stands are also opposite positioned exactly on top of the control magnets.

In another aspect of the method of the present invention, the fixed thread reel moves with the platform, wherein the fixed thread reel moves along a first path, wherein, after, the fixed thread reel passes along the first path at a first point next to the magnetic stand, the magnetic stand moves circularly.

In an additional aspect of the method of the present invention, the control magnet and the magnetic stand together have a second displacement movement that follows a second path, wherein, after, the magnetic stand passes along the second path at a second point next to the fixed thread reel, the magnetic stand moves circularly.

In one more aspect of the method of the present invention, the fixed thread reel moves with the platform, wherein the fixed thread reel moves along a first path, wherein, after, the fixed thread reel passes along the first path at the first point where the fixed thread reel is between the two magnetic stands, the magnetic stands move circularly.

In another aspect of the method of the present invention, the two control magnets and the two magnetic stands together have a second displacement movement that follows a second path, wherein, after, the magnetic stands pass along the second path at a second point next to the fixed thread reel, having passed the fixed thread reel between the two magnetic stands, the magnetic stands move circularly.

Additional objectives and advantages of the present invention will be more evident in the detailed description of the invention and the claims.

BRIEF DESCRIPTION OF THE DRAWINGS

FIG. 8. shows two diagrammatic top views of the machine of the present invention to illustrate the method of the present invention.

DETAILED DESCRIPTION OF THE INVENTION

Figure 1:
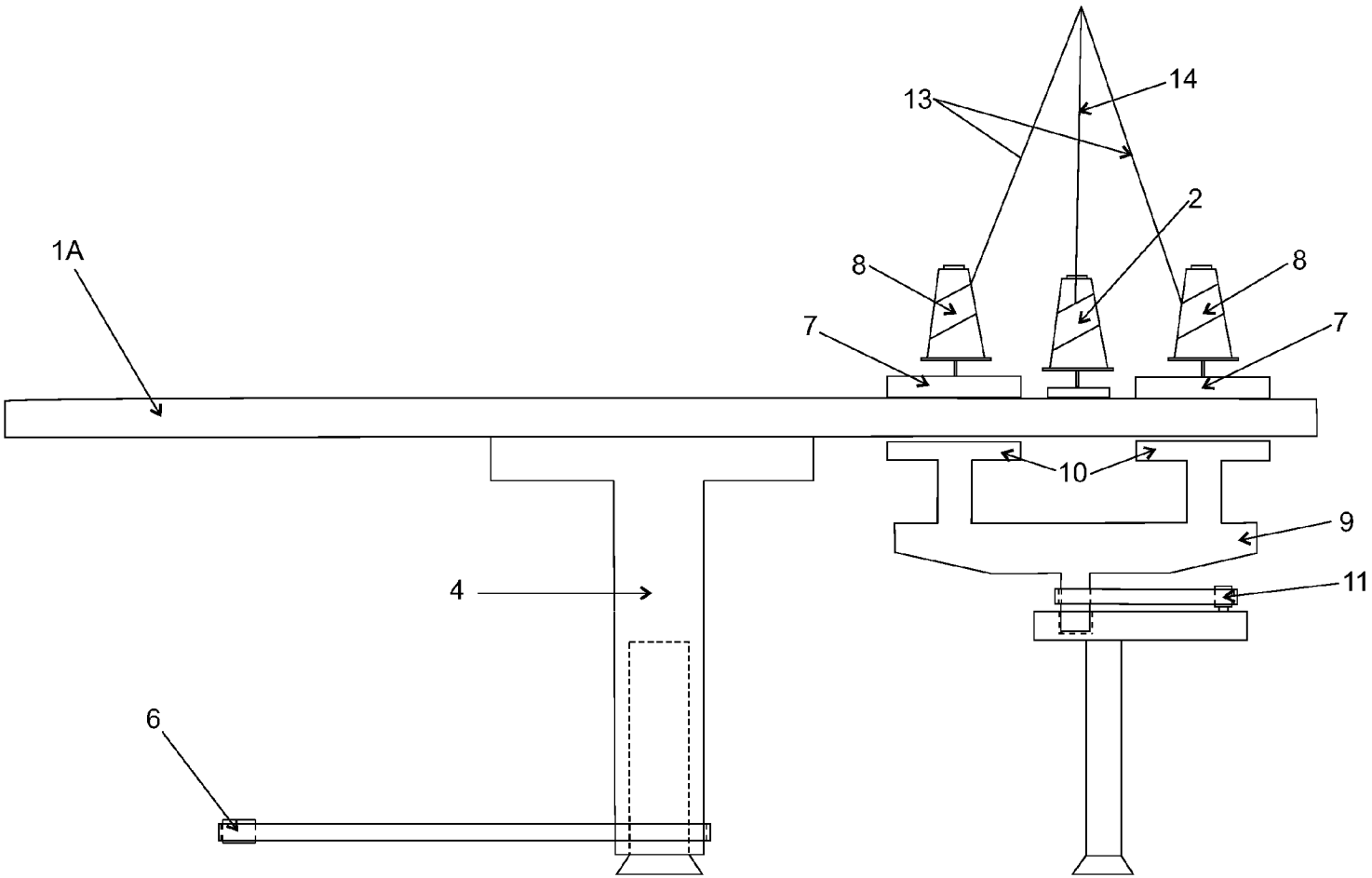
FIG. 1. shows a transversal view a first embodiment of the machine of the present invention.
Figure 2:
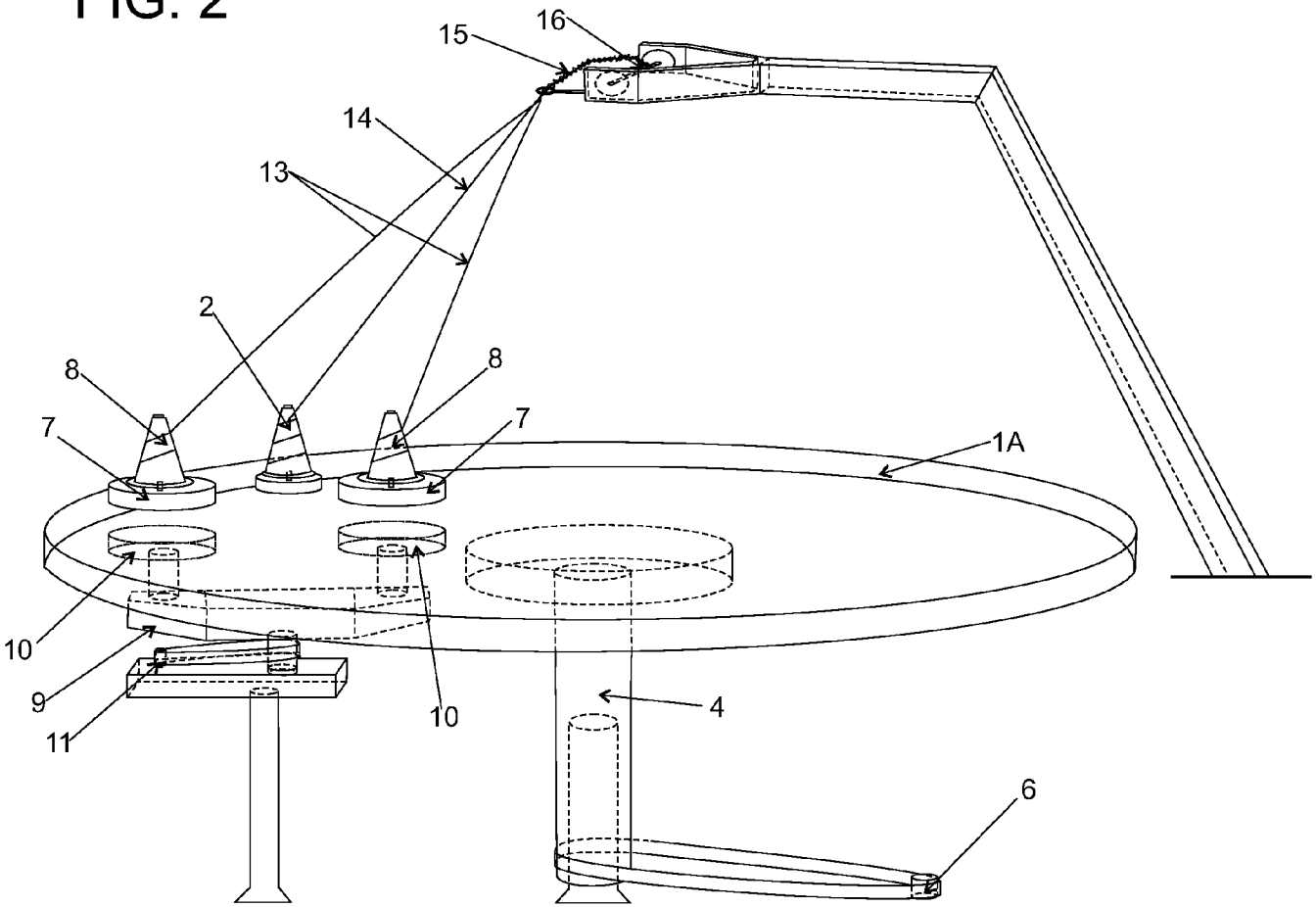
FIG. 2. shows a tridimensional view of the first embodiment of the present invention.

FIGS. 1 and 2 show a first embodiment of the machine for plaiting of the present invention, wherein the machine comprises:

A. A circular movement platform (1A), wherein the circular movement platform (1A) has on top at least one fixed thread reel (2) that moves along a first circumference path (3 arrow indicating displacement with the platform movement) with the platform (1A), wherein the platform (1A) has a center leg (4), wherein the platform (1A) and the center leg (4) are moved circularly (5 arrow indicating platform movement) (FIG. 8) by a first motor (6) that moves the center leg (4) and the platform (1A) in a circular movement (5);

B. At least one magnetic stand (7), wherein the magnetic stand (7) serves as the base for a magnetic stand based thread reel (8), wherein the magnetic stand (7) lies unattached over the platform (1A), wherein the magnetic stand (7) moves freely over the platform (1A); and, C. At least one arm (9) with at least one control magnet (10), wherein the control magnet (10) is immediately underneath the platform (1A) exactly below the magnetic stand (7), wherein the control magnet (10) is moved circularly by a second motor (11), wherein the control magnet (10) emits a magnetic force that moves the magnetic stand (7) in a independent circular movement (12) (FIGS. 7 and 8), and wherein the control magnet (10) and the magnetic stand (7) follow the same synchronous independent circular movement (12 circular arrow indicating circular movement);

Wherein the magnetic stand based thread reel (8) releases a first thread end (13), wherein the fixed thread reel (2) releases a second thread reel (14), wherein, as the magnetic stand (7) moves circularly (12), the first thread end (13) and the second thread end (14) form a braid (15).

Figure 5:
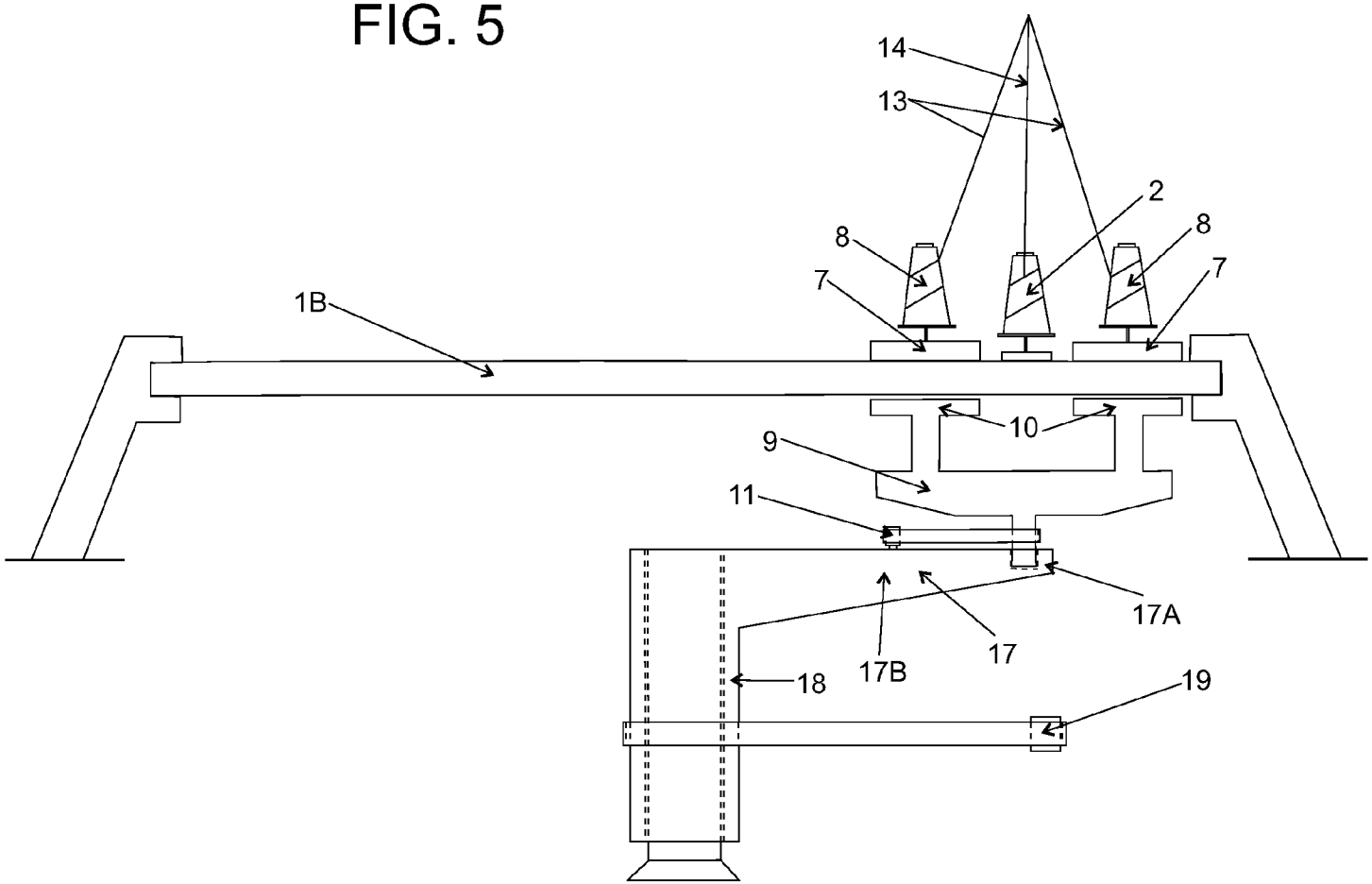
FIG. 5. shows a transversal view of a second embodiment of the machine of the present invention.

The fixed thread reel (2) is fixedly attached to the top of the platform (1A) and (1B) (FIGS. 5 and 6), wherein the fixed thread reel (2) does not move freely on top of the platform (1A) and (1B).

For the purpose of this Patent Application, the term thread is synonymous to other similar terms such as filament, strand, string, fiber, etc.

In all cases in this Patent Application, the term reel means a reel, a cylinder or any device around or over which a thread or a braid can be stored, hoarded, gathered, or rolled.

For the purposes of this Patent Application, threads can be made of all types of materials, e.g., cotton, wool, metal, synthetic polymers, alloys, carbon, etc. Therefore, the machine and the method of the present invention would be used in a broad variety of industries.

For the purpose of this Patent Application, the term "magnetic stand" indicates that the stand is made of any material that can be attracted by a magnetic force emitted by a magnet. The magnetic stand is not attached on top of the platform, and preferably is made of a material which has very low friction with respect to the surface of the platform (1A) and (1B), wherein the magnetic stand (7) slides without effort on top of the platform (1A) and (1B).

For the purpose of this Patent Application the term "control magnet" indicates that the control magnet (10) is made of any material that can emit a magnetic form. For example, a preferably material of which the control magnet (10) is made could be neodymium magnetic material.

In one aspect of the machine of the present invention, the braid (15) is rolled into a braid reel (16).

In another aspect of the machine of the present invention, the at least one arm (9) has at least two control magnets (10), wherein the machine also has at least two magnetic stands (7), wherein the at least two magnetic stands (7) move following an independent circular movement (12), wherein the at least two magnetic stands (7) are opposite an symmetrically positioned (FIGS. 7 and 8 A and B) on the imaginary circular perimeter of the independent circular movement, wherein the at least two control magnets (10) are immediately underneath the platform (1A) and (1B), wherein the at least two control magnets (10) are exactly below the at least two magnetic stands (7), wherein the at least two control magnets (10) govern the independent circular movement (12) of the at least two magnetic stands (7).

Figure 3:
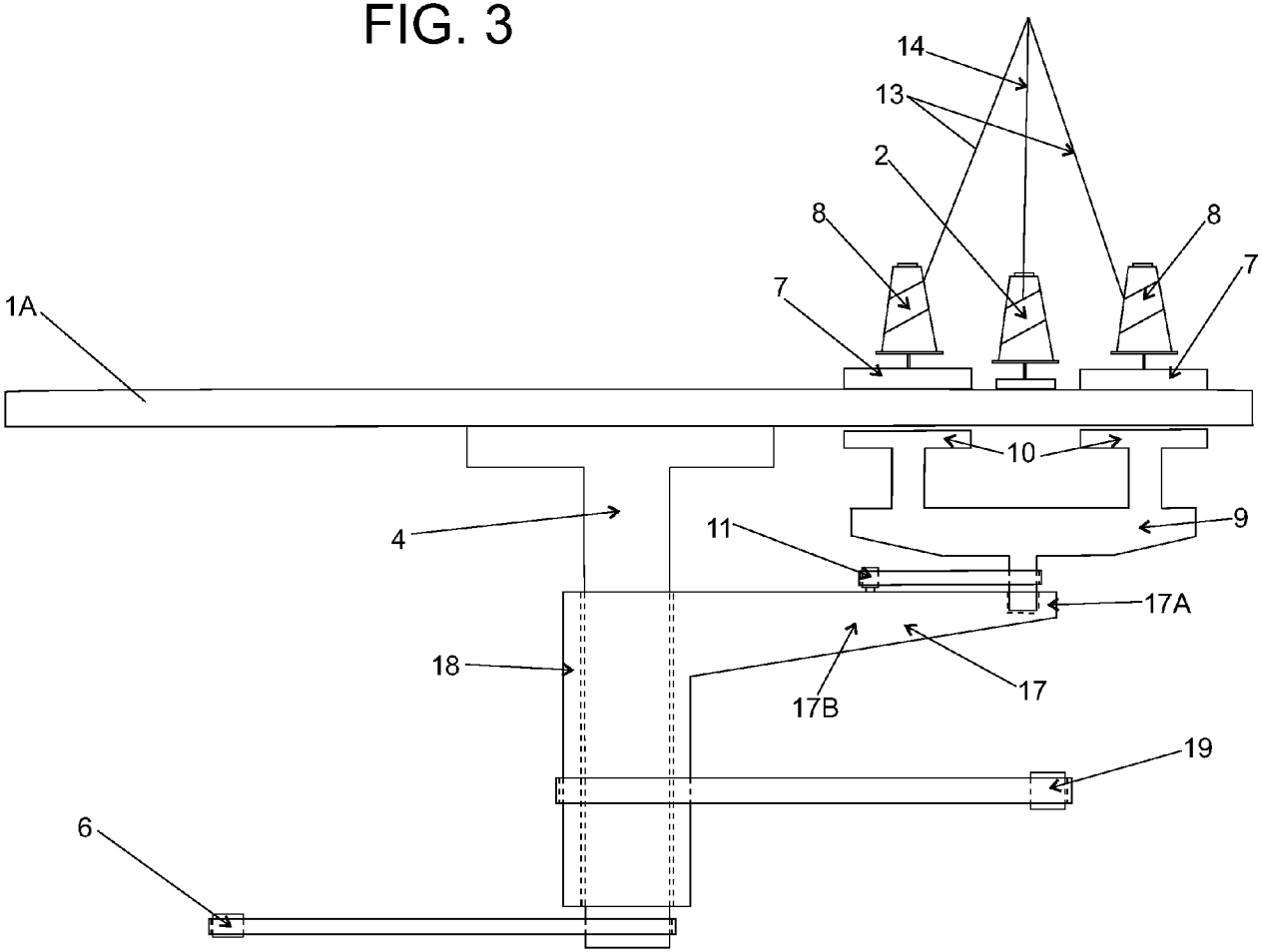
FIG. 3. shows a transversal view of a variation of a first embodiment of the machine of the present invention.
Figure 4:
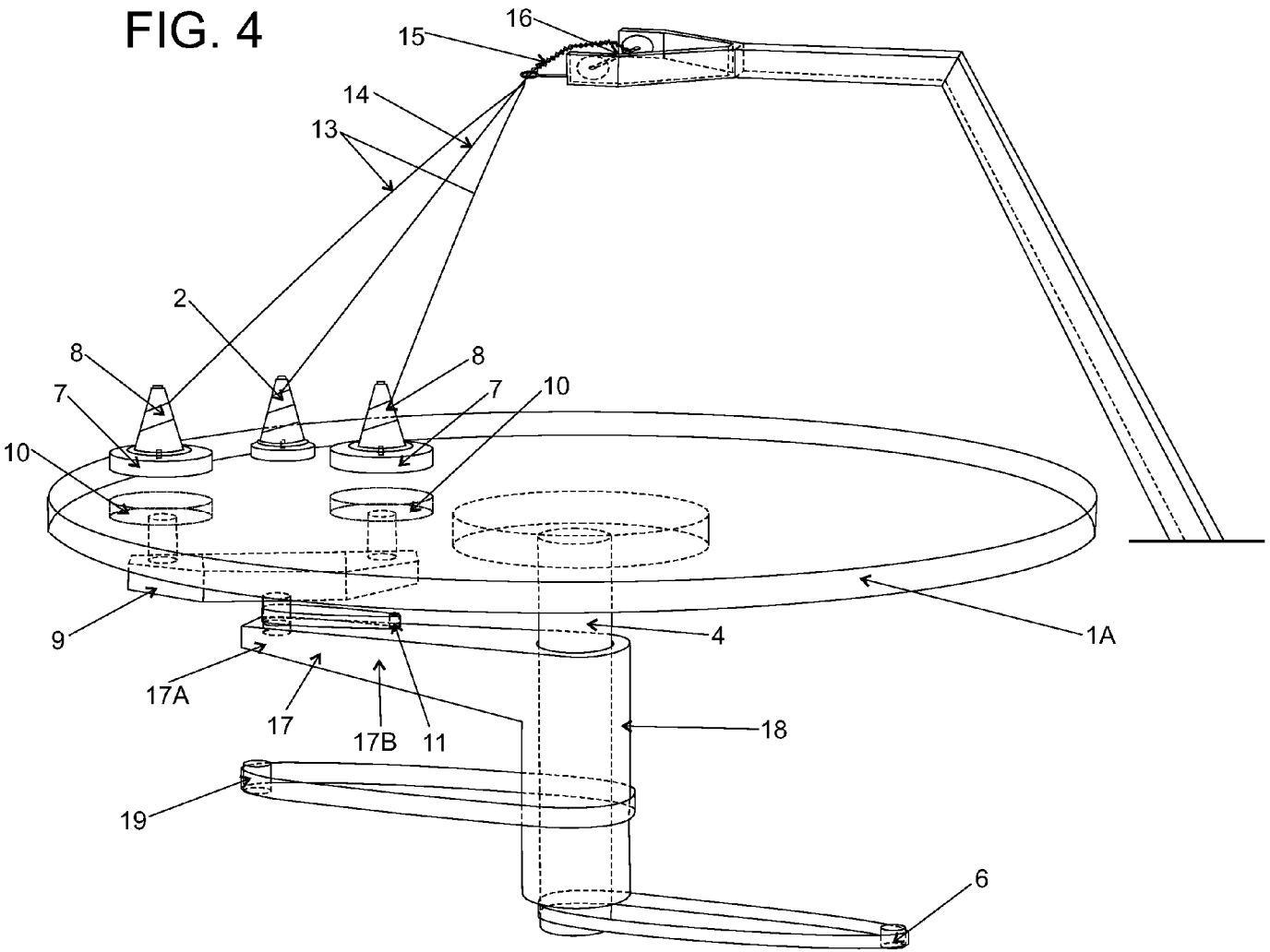
FIG. 4. shows a tridimensional view of a variation of the first embodiment of the present invention.

FIGS. 3 and 4 show a variation of the first embodiment of the machine of the present invention, wherein the arm (9) is supported on a wing (17), wherein the arm (9) is on the wing end (17A), wherein the wing (17) is attached to an axial support (18), wherein the second motor (11) is at the wing body (17B), wherein the wing (17) and the axial support (18) move following a circular movement around the same axis of the circular movement of the center leg (4) and the platform (LA), wherein the machine also has a third motor (19) that moves circularly the wing (17) and the axial support (18), wherein the circular movement of the wing (17) displaces the control magnet (10) circularly, wherein the control magnet (10) pulls the magnetic stand (7) making the magnetic stand (7) to move following a displacement movement (20 indicating displacement) (FIG. 7) over the platform (LA), wherein the magnetic stand (7) circular movement (12) (FIGS. 7 and 8) is independent of the magnetic stand (7) displacement movement (20), wherein the magnetic stand (7) displacement movement (20) is along a second circumference path (20), wherein the first circumference path (3) and the second circumference path (20) are parallel.

In all instances in the present application, preferably, the second motor (11) or later referred in paragraph 0042 C. as a wing motor (11) is positioned on the wing body (17B). However, the term "at the wing body" means that said second motor or wing motor (11) could also be located in any appropriate position in or on the wing (17), e.g., on top of the wing, inside the body of the wing, etc.

Despite of the fact that the circular platform (1A and 1B), and the displacement along the first circumference path (3) and the displacement along the second circumference path (20) is the most efficient and preferably in the design of the machine of the present invention, it is possible to replace a circular platform and the movements along the first circumference path (3) and the second circumference path (20) with a platform that does not move circularly, but a platform that is rectangular and moves longitudinally, and displacement movements of fixed and rotating reels along a first path and a second path that are longitudinally and parallel.

Figure 6:
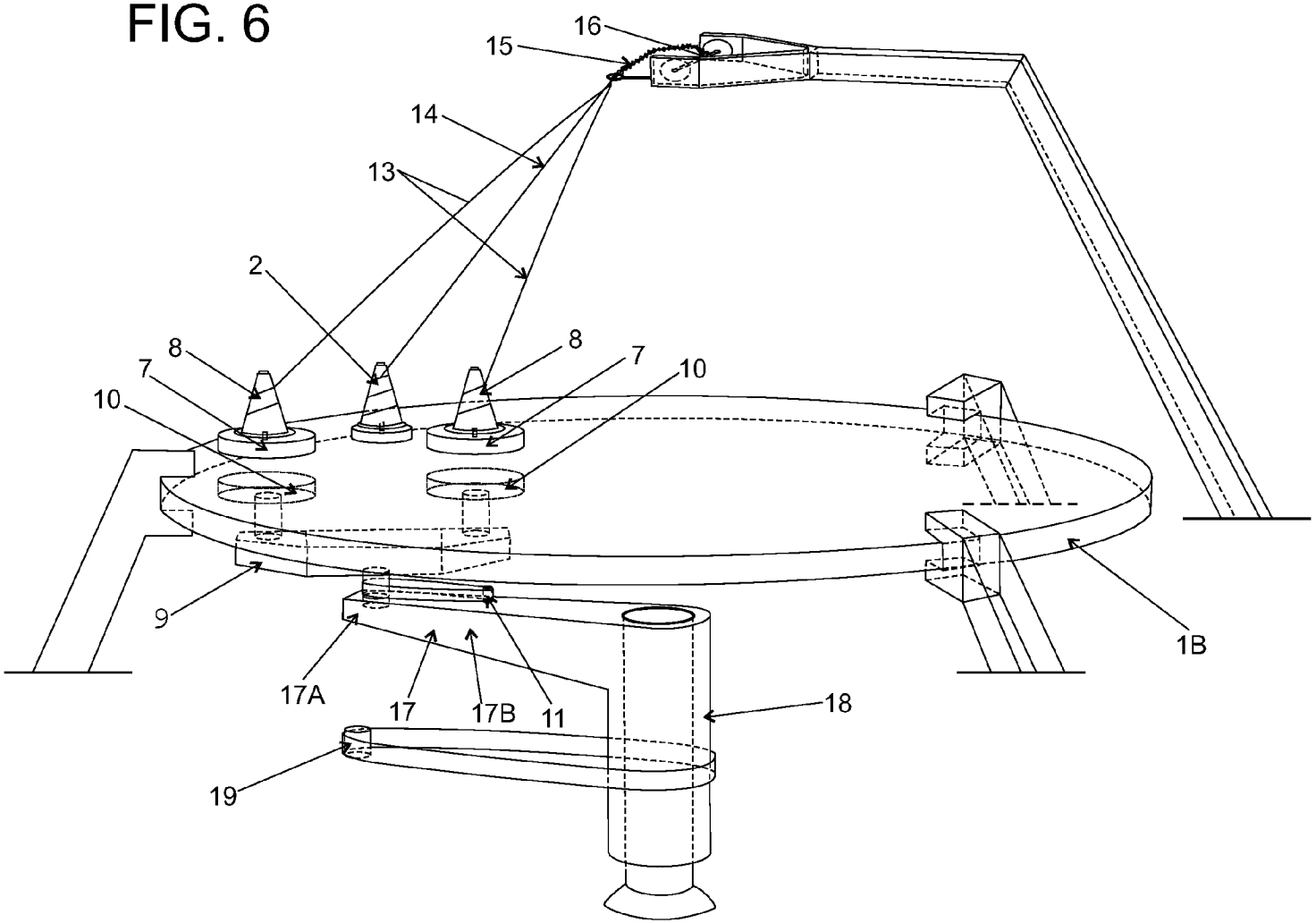
FIG. 6. shows a tridimensional view of the second embodiment of the present invention.
Figure 7:
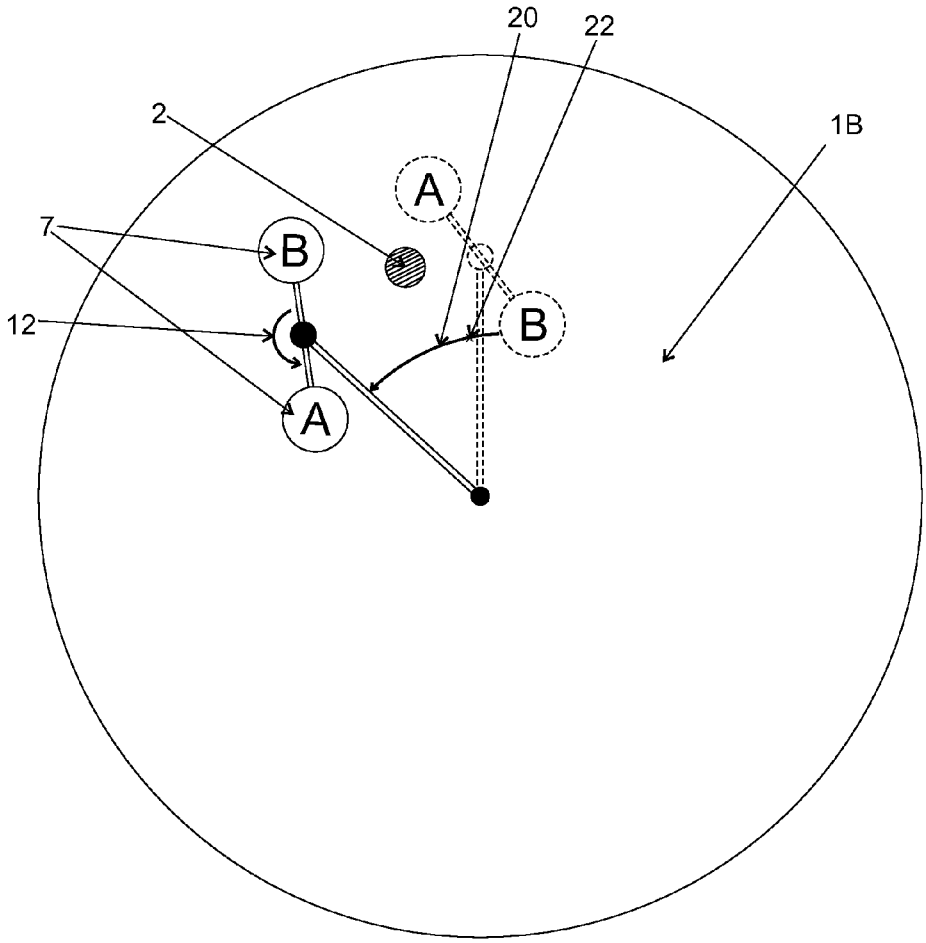
FIG. 7. shows a diagrammatic top view of the machine of the present invention to illustrate the method of the present invention.

FIGS. 6 and 7 show a second embodiment of the machine for plaiting of the present invention, wherein the machine of the second embodiment comprises:

A. A fixed platform (1B) that has on top at least one fixed thread reel (2), wherein the fixed thread reel (2) is positioned in a point that coincides with perimeter line of a first circumference path (3) (FIG. 8);

B. At least one magnetic stand (7), wherein the magnetic stand (7) serves as support for a magnetic stand based thread reel (8), wherein the magnetic stand (7) lies unattached over the platform (1B), wherein the magnetic stand (7) moves freely over the platform (7B);

C. At least one circular movement wing (17) with an axial support (18), wherein the circular movement wing (7) with the axial support is moved by a center motor (19), wherein at the end of the circular movement wing (17A) there is a independent circular movement arm (9) controlled by a wing motor (11) located at said wing body (17B), wherein at the independent circular movement arm (9) there is at least one control magnet (10), wherein the control magnet (10) is underneath the platform (1B), wherein the control magnet (10) is exactly below the magnetic stand (7), wherein, as the arm (7) and the control magnet (10) move circularly; wherein the wing (17) circular movement around the axial support (18) displaces the arm (9) with control magnet (10) around the axial support (18), wherein the control magnet (10) emits a force that pulls the magnetic stand (7) to move following a displacement movement over the platform (20), wherein the control magnet (10) force also pulls the magnetic stand (7) into an independent circular movement, wherein both, the control magnet (10), and the magnetic stand (7), have the same synchronous circular movement and the same displacement movement (20), and wherein the magnetic stand (7) displacement movement over the platform (1B) follows a second circumference path (20), wherein the first circumference path (3) and the second circumference path are parallel (20) (Although is this second embodiment the platform does not move around since it is fixed (FIGS. 5 and 6), and therefore the fixed thread reel does not move either, a first circumference path is mentioned to indicate that if an imaginary circumference perimeter is traced, it will coincide with a circumference path as if the fixed thread reel would move);

Wherein the magnetic stand based thread reel (8) releases a first thread end (13), wherein the fixed thread reel (2) releases a second thread reel (14), wherein, as the magnetic stand (7) moves circularly, the first thread end (13) and the second thread end (14) form a braid (15).

In an aspect of the second embodiment of the machine of the present invention, the braid (15) is rolled into a braid reel (16).

In another aspect of the second embodiment of the machine of the present invention, at the independent movement arm (9) there is at least two control magnets (10), wherein the at least two control magnets (10) are underneath the platform (1B), wherein the machine also has at least two magnetic stands (7) that serve as bases for two thread reels (8), wherein the at least two magnetic stands (7) lie unattached on top of the platform (1B), wherein at least two magnetic stands (7) move freely on top of the platform (1B), wherein at least two magnetic stands (7) are exactly above the at least two control magnets (10), wherein the at least two control magnets (10) emit a force that pulls the at least two magnetic stands (7), wherein both, the control magnets (10), and the magnetic stands (7), have the same synchronous circular movement (12) and the same displacement movement (20).

In all cases of the present application, the first (6), second (wing motor) (11) and third (19) motors can be controlled and synchronized in order to obtain precise movements of the center leg (4) and the circularly moving platform (1A), the arm (9), and the wing (17) and the axial support (18), either by analogous or digital means, e.g., PLC (programmable logic control), computer numeric control, etc.

In all cases in the present application, depending on the number of magnetic stands (7) (which will be equal to the number of control magnets (10)) per arm (9), the rotating movement (12) of each magnetic stand would be different, e.g., more than 180 degrees when there is only one magnetic stand, 180 degrees or less when there are two magnetic stands, 120 degrees or less when there are three magnetic stands, and so on.

The present invention also provides a method of plaiting braids in a machine, wherein the method is mainly illustrated in diagrams of FIGS. 7 and 8 (FIGS. 1-6 show additional illustrative details), wherein the machine comprises:

E. A platform (1A or 1B)

F. At least one magnetic stand (7) lying on top of the platform (1A or 1B) (although, preferably the platform is circular, the platform could also have a different geometrical perimeter as explained in paragraph 0041), wherein on top of the magnetic stand (7) there is a magnetic stand based thread reel (8), G. At least one fixed thread reel (2) attached on top of the platform (1A or 1B);

H. A least one control magnet (10) underneath the platform (1A or 1B), wherein the control magnet (10) is exactly below the magnetic stand (7), wherein the control magnet (10) is on an arm (9), wherein the arm (9) is moved circularly by a motor (11), wherein the control magnet (10) emits a magnetic force that pulls the magnetic stand (7), wherein the magnetic stand (7) also moves circularly and synchronously with the control magnet (10), wherein the magnetic stand thread reel (8) releases a first thread end (13), and wherein fixed thread reel (2) releases a second thread reel (14), wherein, as the magnetic stand (7) moves circularly (12), the first thread end (13) and the second thread end (14) form a braid (15).

In an aspect of the method of the present invention, the arm has at least two control magnets (10), and the machine also has two magnetic stands (7) with magnetic stand based thread reels (8), wherein the two control magnets (10) are positioned opposite on the arm wherein the two magnetic stands (7) are also opposite (FIGS. 7 and 8) positioned exactly on top of the control magnets (10).

In another aspect of the method of the present invention, the fixed thread reel (2) moves with the platform (1A) (FIG. 8B), wherein the fixed thread reel (8) moves along a first path (3), wherein, after, the fixed thread reel (2) passes along the first path (3) at a first point (21) next to the magnetic stand (7), the magnetic stand (7) moves circularly (12).

In an additional aspect of the method of the present invention, the control magnet (10) and the magnetic stand (7) together have a second displacement movement (20) (FIG. 7) that follows a second path (20), wherein, after, the magnetic stand (7) passes along the second path (20) at a second point (22) next to the fixed thread reel (2), the magnetic stand (7) moves circularly (12).

In one more aspect of the method of the present invention, the fixed thread reel (2) moves with the platform (FIG. 8B), wherein the fixed thread reel (2) moves along a first path (3), wherein, after, the fixed thread reel (2) passes along the first path (3) at the first point (21) where the fixed thread reel (21) is between the two magnetic stands (7), the magnetic stands move circularly (12).

In another aspect of the method of the present invention, the two control magnets (10) and the two magnetic stands (7) together have a second displacement movement (20) that follows a second path (20), wherein, after, the magnetic stands (7) pass along the second path (20) at a second point (22) next to the fixed thread reel (8), having passed the fixed thread reel (8) in between the magnetic stands (7), the magnetic stands (7) move circularly (12).

Although the description presents preferred embodiments of the present invention, additional changes may be made in the form and disposition of the parts without deviating from the ideas and basic principles encompassed by the claims.

The invention claimed is:

1. A machine for plaiting, wherein the machine comprises:

D. A circular movement platform, wherein the circular movement platform has on top at least one fixed thread reel that moves along a first circumference path with the platform, wherein the platform has a center leg, wherein the platform and the center leg are moved circularly by a first motor that moves the center leg and the platform in a circular movement;

E. At least one magnetic stand, wherein the magnetic stand serves as the base for a magnetic stand based thread reel, wherein the magnetic stand lies unattached over the platform, wherein the magnetic stand moves freely over the platform; and, F. At least one arm with at least one control magnet, wherein the control magnet is immediately underneath the platform exactly below the magnetic stand, wherein the control magnet is moved circularly by a second motor, wherein the control magnet emits a magnetic force that moves the magnetic stand in a independent circular movement, and wherein the control magnet and the magnetic stand follow the same synchronous independent circular movement;

wherein the magnetic stand based thread reel releases a first thread end, wherein the fixed thread reel releases a second thread reel, wherein, as the magnetic stand moves circularly, the first thread end and the second thread end form a braid.

2. The machine of claim 1, wherein the braid is rolled into a braid reel.

3. The machine of claim 1, wherein the at least one arm has at least two control magnets, wherein the machine also has at least two magnetic stands, wherein the at least two magnetic stands move following an independent circular movement, wherein the at least two magnetic stands are opposite an symmetrically positioned on the imaginary circular perimeter of the independent circular movement, wherein the at least two control magnets are immediately underneath the platform, wherein the at least two control magnets are exactly below the at least two magnetic stands, wherein the at least two control magnets govern the independent circular movement of the at least two magnetic stands.

4. The machine of claim 1, wherein the arm is supported on a wing, wherein the arm is on the wing end, wherein the wing is attached to an axial support, wherein the second motor is at the wing body, wherein the wing and the axial support move following a circular movement around the same axis of the circular movement of the center leg and the platform, wherein the machine also has a third motor that moves circularly the wing and the axial support, wherein the circular movement of the wing displaces the control magnet circularly, wherein the control magnets pulls the magnetic stand making the magnetic stand to move following a displacement movement over the platform, wherein the magnetic stand circular movement is independent of the magnetic stand displacement movement, wherein the magnetic stand displacement movement is along a second circumference path, wherein the first circumference path and the second circumference path are parallel.

5. A machine for plaiting, wherein the machine comprises:

D. A fixed platform that has on top at least one fixed thread reel, wherein the fixed thread reel is positioned in a point that coincides with perimeter line of a first circumference path;

E. At least one magnetic stand, wherein the magnetic stand serves as support for a magnetic stand based thread reel, wherein the magnetic stand lies unattached over the platform, wherein the magnetic stand moves freely over the platform;

F. At least one circular movement wing with an axial support, wherein the circular movement wing with the axial support is moved by a center motor, wherein at the end of the circular movement wing there is a independent circular movement arm controlled by a wing motor located at said wing body, wherein at the independent circular movement arm there is at least one control magnet, wherein the control magnet is underneath the platform, wherein the control magnet is exactly below the magnetic stand, wherein, as the arm moves circularly, the control magnet moves circularly; wherein the wing circular movement around the axial support displaces the arm with control magnet around the axial support, wherein the control magnet emits a force that pulls the magnetic stand to move following a displacement movement over the platform, wherein the control magnet force also pulls the magnetic stand into an independent circular movement, wherein both, the control magnet, and the magnetic stand, have the same synchronous circular movement and the same displacement movement, and wherein the magnetic stand displacement movement over the platform follows a second circumference path, wherein the first circumference path and the second circumference path are parallel;

wherein the magnetic stand based thread reel releases a first thread end, wherein the fixed thread reel releases a second thread reel, wherein, as the magnetic stand moves circularly, the first thread end and the second thread end form a braid.

6. The machine of claim 5, wherein the braid is rolled into a braid reel.

7. The machine of claim 5, wherein at the independent movement arm there is at least two control magnets, wherein the at least two control magnets are underneath the platform, wherein the machine also has at least two magnetic stands that serve as bases for two thread reels, wherein the at least two magnetic stands lie unattached on top of the platform, wherein at least two magnetic stands move freely on top of the platform, wherein at least two magnetic stands are exactly above the at least two control magnets, wherein the at least two control magnets emit a force that pulls the at least two magnetic stands, wherein both, the control magnets, and the magnetic stands, have the same synchronous circular movement and the same displacement movement.

8. A method of plaiting braids in a machine, wherein the machine comprises:

I. A platform

J. At least one magnetic stand lying on top of the platform, wherein on top of the magnetic stand there is a magnetic stand based thread reel, K. At least one fixed thread reel attached on top of the platform;

L. A least one control magnet underneath the platform, wherein the control magnet is exactly below the magnetic stand, wherein the control magnet is on an arm, wherein the arm is moved circularly by a motor, wherein the control magnet emits a magnetic force that pulls the magnetic stand, wherein the magnetic stand also moves circularly and synchronously with the control magnet, wherein the magnetic stand thread reel releases a first thread end, and wherein fixed thread reel releases a second thread reel, wherein, as the magnetic stand moves circularly, the first thread end and the second thread end form a braid.

9. The method of claim 8, wherein the arm has at least two control magnets, and the machine also has two magnetic stands with magnetic stand based thread reels, wherein the two control magnets are positioned opposite on the arm, wherein the two magnetic stands are also opposite positioned exactly on top of the control magnets.

10. The method of claim 8, wherein, the fixed thread reel moves with the platform, wherein the fixed thread reel moves along a first path, wherein, after, the fixed thread reel passes along the first path at a first point next to the magnetic stand, the magnetic stand moves circularly.

11. The method of claim 8, wherein the control magnet and the magnetic stand together have a second displacement movement that follows a second path, wherein, after, the magnetic stand passes along the second path at a second point next to the fixed thread reel, the magnetic stand moves circularly.

12. The method of claim 9, wherein, the fixed thread reel moves with the platform, wherein the fixed thread reel moves along a first path, wherein, after, the fixed thread reel passes along the first path at the first point where the fixed thread reel is between the two magnetic stands, the magnetic stands move circularly.

13. The method of claim 9, the two control magnets and the two magnetic stands together have a second displacement movement that follows a second path, wherein, after, the magnetic stands pass along the second path at a second point next to the fixed thread reel, having passed the fixed thread reel between the two magnetic stands, the magnetic stands move circularly.

* * * * *